United States Patent [19]

Ichikawa

[11] Patent Number: 4,557,425

[45] Date of Patent: Dec. 10, 1985

[54] PROBLEM-CARTRIDGE FILM PROCESSING METHOD

[75] Inventor: Koji Ichikawa, Kanagawa, Japan

[73] Assignee: Fuji Photo Film Co., Ltd., Kanagawa, Japan

[21] Appl. No.: 623,296

[22] Filed: Jun. 22, 1984

[30] Foreign Application Priority Data

Jun. 24, 1983 [JP] Japan ..... 58-114834

[51] Int. Cl.[4] ..... B65H 17/20

[52] U.S. Cl. ..... 242/55; 354/313; 354/319

[58] Field of Search ..... 242/55, 195; 209/559, 209/656, 657, 702; 206/53, 54, 400, 398; 53/397; 354/298, 319–322, 313–314

[56] References Cited

U.S. PATENT DOCUMENTS 2,928,538 3/1960 Mills ..... 206/53
4,094,726 6/1978 Hujer et al. ..... 354/313 X
4,231,478 11/1980 Stone ..... 209/657 X
4,283,021 8/1981 Nishida ..... 242/55

FOREIGN PATENT DOCUMENTS 2744595 4/1978 Fed. Rep. of Germany ..... 354/319

*Primary Examiner*—John M. Jillions
*Attorney, Agent, or Firm*—Sughrue, Mion, Zinn, Macpeak & Seas

[57] ABSTRACT

A method for processing film cartridges, especially for processing cartridges for which it is not possible to extract the leader of the film from the cartridge by an ordinary automatic method. The spool of the cartridge is first turned in the forward direction so as to attempt to extract the leader from the cartridge. If the leader has not been extracted within a designated period of time, the spool of the cartridge is rotated in the rewinding direction and a retaining clip is placed around the cartridge. The cartridge is then dropped into a troubled-cartridge collecting box having an identification number corresponding to the cartridge and to its respective development/processing envelope.

6 Claims, 1 Drawing Figure

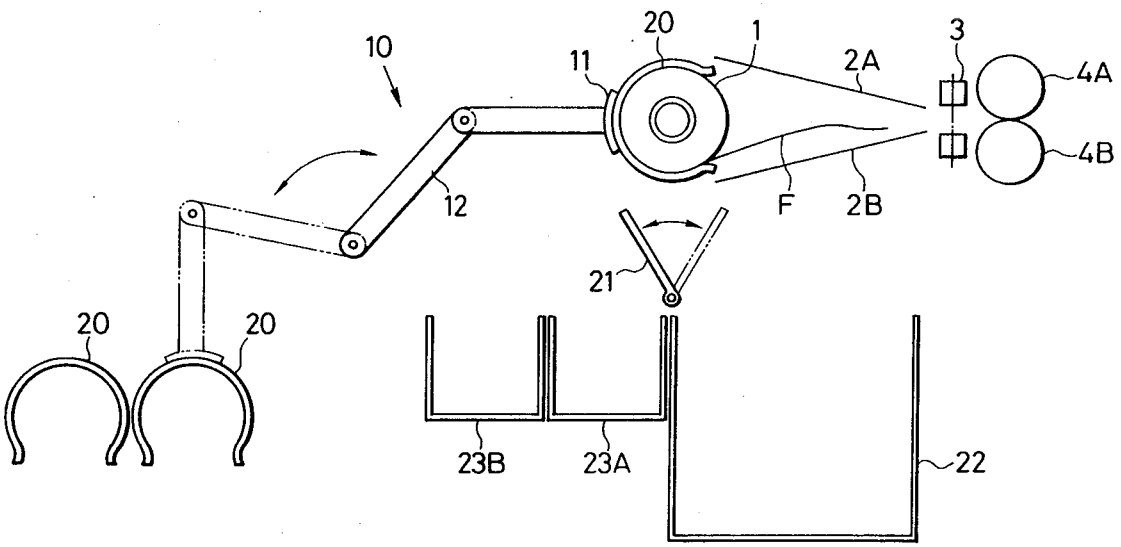
4A
4B
3
2A
2B
F
1
20
11
10
12
21
22
23A
23B
20
20

PROBLEM-CARTRIDGE FILM PROCESSING METHOD

BACKGROUND OF THE INVENTION

The present invention relates to a method for processing film cartridges in the beginning stages of a film developing operation. More specifically, the invention relates to a method for processing film cartridges in which it is not possible with the ordinary apparatus to extract the film from the cartridge.

At the start of a film developing operation, it is of course necessary to extract the film from the cartridge in which it is wound. If the leader of the film cannot be satisfactorily extracted, then it is necessary to remove such a cartridge from the ordinary film processing line and to process the cartridge in another manner, such as manually.

SUMMARY OF THE INVENTION

It is an object of the present invention to provide a method for processing problem film cartridges in which, when it is found impossible to extract the leader of the film from the cartridge in the ordinary manner, the cartridge is removed from the ordinary processing line and processed elsewhere.

The foregoing and other objects of the invention have been achieved by the provision of a troubled-cartridge processing method in which it is first attempted to extract the film from the cartridge by turning the spool of the cartridge in the forward direction (the direction opposite that in which the film is rewound in the camera after it has been exposed). If the leader of the film is not detected within a predetermined time period, it is judged that the cartridge has a problem or defect. In this case, the spool is then turned in the rewinding direction (the same direction in which the film is rewound in the camera after it has been exposed). Then, a holding clip is placed around the cartridge and the cartridge is conveyed to a defective cartridge collecting box having an identification number corresponding to the cartridge and its respective development/processing envelope or "mailer".

BRIEF DESCRIPTION OF THE DRAWING

The single drawing FIGURE depicts operations in a cartridge film processing method of the invention.

DESCRIPTION OF THE PREFERRED EMBODIMENTS

The FIGURE is a side view showing essential components of a film handling device which may be used for practicing a defective cartridge film processing method according to the invention. In the FIGURE, reference numeral 1 designates a cartridge in which film F has been wound and is now to be extracted from the cartridge for developing. Guides 2A and 2B guide the film F when it is successfully extracted from the cartridge 1 and forwarded for developing. A film detector 3 detects the presence of the forwarded film. Reference numerals 4A and 4B indicate a pair of film conveying rollers, which are driven when a film detection signal is received from the detector 3. The spool of cartridge 1 can be rotated either in the forward or rewinding direction.

Further in the FIGURE, reference numeral 10 designates a film cartridge holding device which can be reciprocated between a first position indicated in solid lines and a second position indicated by broken lines by a drive mechanism (not shown). At the first position, an attempt is made to extract the film F from the cartridge 1 by rotating the spool of the cartridge 1 in the forward direction. If the leader of the film F is not detected by the detector 3 within a predetermned period of time, the spool of the cartridge 1 is rotated in the opposite direction, that is, in the film rewinding direction, so as to ensure that the film is wound back inside the cartridge. Then, the arm 12 of the device 10 is moved to its second position where a vacuum-operated holding member 11 picks up a clip 20, and is then moved back to the first position to place the clip 20 around the cartridge 1. The purpose of the clip 20 is to prevent the film from coming out of the cartridge 1 and being unwound before the desired time.

After the clip 20 has been placed around the defective cartridge, a distributing member 21 is moved to the position indicated by a broken line. The cartridge 1 is then released, and is deflected by the distributing member 21 into a collecting box 23A or 23B, which is provided with an identification number corresponding to the cartridge and its associated development/processing envelope or "mailer". Problem cartridges collected in the collecting boxes 23A, 23B, etc. can then be processed by another method, such as manually. Ordinarily, the distributing member 21 is placed in the position indicated by solid lines so that the cartridges may be collected in an empty cartridge collecting box 22 after the film F has been extracted therefrom.

Preferably, the clips 20 ae made of a plastic material. However, metal clips, particularly, magnetic clips, can be used as well.

This completes the description of the preferred embodiments of the invention. Although preferred embodiments have been described, numerous modifications and alterations thereto would be apparent to one of ordinary skill in the art without departing from the spirit and scope of the invention.

I claim:

1. A method for processing film cartridges, comprising the steps of:

turning a spool of a cartridge containing film to be processed in a forward direction so as to cause a leader of said film to be forwarded from said cartridge;

detecting the presence of said leader;

if said leader is not detected within a predetermined period of time after commencing turning said spool of said cartridge, turning said spool in a rewinding direction, placing retaining means around said cartridge, and forwarding said cartridge to a defective-cartridge collecting area; and if said leader is detected within said predetermined period of time, extracting said film with film conveying means; and discarding the empty cartridge into an empty cartridge collection area when said film has been extracted.

2. The method according to claim 1, wherein said step of placing said retaining means around said cartridge comprises picking up a film clip with an articulated arm having a suction device at an outward end thereof, and rotating said arm to place said film clip around said cartridge.

3. The film processing method according to claim 1, further comprising the step of positioning a cartridge distributing member at a first position to direct said cartridge to said defective-cartridge collecting area when the presence of said leader has not been detected within said predetermined period of time, and positioning said distributing member to direct said cartridge to said empty cartridge collection area when said film has been extracted from said cartridge.

4. The film processing method according to claim 1, wherein said step of extracting said film comprises engaging said film with a pair of film conveying rollers, and rotating said rollers to withdraw said film from said cartridge.

5. The film processing method according to claim 1, further comprising the step of defining a discrete number of said defective-cartridge collecting areas, and assigning to each said area upon the forwarding of a cartridge to this area an identifying means which associates said cartridge with said area.

6. The film processing method according to claim 5, wherein said assigning step comprises providing said area with an identification number corresponding to the cartridge.

* * * * *